US005238706A

United States Patent [19]

Huffman

[11] Patent Number: 5,238,706

[45] Date of Patent: Aug. 24, 1993

[54] ANTISTATIC FILM BASES AND THEIR PROCESS OF MANUFACTURING

[75] Inventor: William A. Huffman, Pittsford, N.Y.

[73] Assignee: Minnesota Mining and Manufacturing Company, St. Paul, Minn.

[21] Appl. No.: 905,897

[22] Filed: Jun. 26, 1992

[51] Int. Cl.[5] ..... G03C 1/85

[52] U.S. Cl. ..... 427/177; 427/393.1; 427/393.5; 430/527; 430/529

[58] Field of Search ..... 427/400, 177, 393.1, 427/393.5; 430/527, 529; 57/901

[56] References Cited

U.S. PATENT DOCUMENTS

| | | | |
|---|---|---|---|
| 3,615,531 | 10/1971 | Meyer et al. | 430/527 |
| 3,772,070 | 11/1973 | Luckenbach | 427/177 |
| 3,779,773 | 12/1973 | Inayama et al. | 430/527 |
| 3,786,002 | 1/1974 | Paesschen | 252/500 |
| 3,857,729 | 12/1974 | Burwasser | 117/73 |
| 4,147,550 | 4/1979 | Campbell et al. | 430/529 |
| 4,209,584 | 6/1980 | Joseph | 430/527 |
| 4,225,665 | 9/1980 | Schadi, III | 430/529 |
| 4,743,476 | 5/1988 | Miller | 427/430.1 |
| 4,810,624 | 3/1989 | Hardam et al. | 430/527 |
| 4,882,894 | 11/1989 | Havens et al. | 53/461 |
| 5,098,822 | 3/1992 | Tachibana et al. | 430/527 |
| 5,135,843 | 8/1992 | Takamuki et al. | 430/527 |

FOREIGN PATENT DOCUMENTS

| | | | |
|---|---|---|---|
| 543245 | 7/1957 | Canada | 430/527 |
| 617482 | 4/1961 | Canada | 427/400 |
| 0036702 | 9/1981 | European Pat. Off. . | |
| 409665 | 1/1991 | European Pat. Off. | 430/527 |
| 2208651 | 2/1990 | Japan | 430/527 |
| 3206444 | 9/1991 | Japan | 430/527 |
| 3279943 | 12/1991 | Japan | 430/529 |
| 815662 | 7/1959 | United Kingdom . | |
| 2224128 | 4/1990 | United Kingdom . | |

OTHER PUBLICATIONS

Kirk and Othmer, Encyclopedia of Chemical Technology, Third Edition, 1979, vol. 3, 149–183.

*Primary Examiner*—Michael Lusigan
*Assistant Examiner*—Erma Cameron
*Attorney, Agent, or Firm*—Gary L. Griswold; Walter N. Kirn; Mark A. Litman

[57] ABSTRACT

The crosslinking of an antistatic polymer and crosslinking agent on a flexible polymer abstract is enhanced by wrapping of the antistatic coated polymer substrate and heating said wrapped substrate to crosslink the coating.

25 Claims, No Drawings

ANTISTATIC FILM BASES AND THEIR PROCESS OF MANUFACTURING

FIELD OF THE INVENTION

The present invention relates to photographic film bases which are provided with antistatic layers, to light-sensitive photographic elements comprising said film bases, and especially to processes for making such film bases.

BACKGROUND OF THE ART

The use of polymeric film bases for carrying photographic layers is well known. In particular, photographic elements which require accurate physical characteristics use polyester film bases, such as poly(ethylene terephthalate) film bases. In fact, polyester film bases, when compared with commonly used cellulose ester film bases, are more dimensionally stable and more resistant to mechanical stresses under any employment conditions.

It is known that the formation of static electric charges on the film base is a serious problem in the production of photographic elements. While coating the light-sensitive photographic emulsion, electric charges accumulated on the base discharge, producing light which is recorded as an image on the light-sensitive layer. Other drawbacks which result from the accumulation of electric charges on polymeric film bases are the adherence of dust and dirt and coating defects.

Additionally, photographic elements comprising light-sensitive layers coated onto polymeric film bases, when used in rolls or reels which are mechanically wound and unwound or in sheets which are conveyed at high speed, tend to accumulate static charges and record the light generated by the static discharges.

The static-related damages may occur not only before the photographic element has been manufactured, exposed and processed, but also after processing when the photographic element including the image is used to reproduce or enlarge the image. Accordingly, it is desired to provide permanent antistatic protection, that is, an antistatic protection which retains its effectiveness even after photographic processing.

Several techniques have been suggested to protect photographic elements from the adverse effects of static charges.

Matting agents, hygroscopic materials or electroconductive polymers have been proposed to prevent static buildup, each acting with a different mechanism. However, matting agents cause haze, dust and dirt problems; hygroscopic materials cause sheets or films to stick together or with other surfaces; and electroconductive polymers are not permanent after photographic processing or are not transparent when coated with conventional binders.

U.S. Pat. No. 4,225,665 discloses permanent antistatic layers for photographic elements. Said layers consist essentially of three components: (1) a water-soluble, electrically conductive polymer comprising carboxylic groups, (2) a hydrophobic polymeric binder containing carboxylic groups, and (3) a polyfunctional aziridine crosslinking agent. This composition, however, allows premature reactions among the components prior to coating. U.S. Pat. No. 4,701,403 suggests a costly system of coating the components as two separate coatings to avoid these premature reactions.

U.S. Pat. No. 4,585,730 discloses a photographic element comprising a film base, a silver halide emulsion on one side of the support, and an antistatic layer on the other side of said support, wherein the antistatic layer is coated with an auxiliary gelatin layer containing a conductive polymer, whereby the antistatic properties of the antistatic layer are conducted through said auxiliary layer. Reference is made to U.S. Pat. Nos. 4,225,665 and 4,701,403 as useful antistatic layers to be coated with the auxiliary layer according to U.S. Pat. No. 4,585,730. This two layer construction, however, often suffers from poor adhesion between the two layers during photographic processing.

U.S. patent application Ser. No. 07/797,456, filed in the name of Valsecchi et al. describes a polymeric film base with at least one side coated with an antistatic layer comprising the reaction product of 1) a water-soluble, electrically conductive polymer containing carboxylic groups and 2) a polyfunctional epoxide crosslinking agent. The actual full-scale manufacture of this type of product has been extremely difficult to achieve with any consistency. The product has been found to have variable performance levels which have been difficult to control by any conventional methods.

Accordingly, the application to light-sensitive photographic materials of antistatic compositions is very difficult and there is a continuing need for providing permanent antistatic protection which does not affect other necessary characteristics of the material.

SUMMARY OF THE INVENTION

In one embodiment, the invention is directed to a polymeric film base at least one side of which is coated with an antistatic layer comprising the reaction product of (a) a water-soluble, electrically conductive polymer (preferably one containing carboxylic groups) and (b) a crosslinking agent for said electrically conductive polymer (preferably with a carboxylic acid containing polymer, a polyfunctional epoxide crosslinking agent is used), the reaction product having reduced levels of water extractable components.

In a specific embodiment, the invention is directed to a photographic element comprising a polymeric film base, a silver halide emulsion layer on said film base, and an antistatic layer which comprises the reaction product of (1) a water-soluble, electrically conductive polymer containing carboxylic groups and (2) a polyfunctional epoxide crosslinking agent. This antistatic layer may be present as a backing layer on the side of the film base opposite the silver halide emulsion layer, as a subbing layer between the film base and the emulsion layer in a single or double side coated photographic element, and/or as a subbing layer between the film base and a different backing layer. Either or both sides may be coated. The layer has a reduced level of water extractable components.

The coated film base of the present invention is made by coating a polymeric film base with a crosslinkable composition comprising the electrically-conductive polymer described above and the crosslinking agent, gently drying the coated layer, rolling or winding the coated film base, then heating the rolled coated film base to cure the coating layer.

DETAILED DESCRIPTION OF THE INVENTION

The present invention comprises an antistatic film base particularly useful for imaging media, especially silver halide photographic media. The film base comprises a polymeric substrate such as a polyester, and especially such as polyethyleneterephthalate. Other useful polymeric substrates include, for example, cellulose acetates, polyolephins, polycarbonates and the like. The film base has an antistatic layer adhered to one or both major surfaces of the base. A primer layer or subbing layer may be used between the base itself and the antistatic layer as it is known in the art. Priming and subbing layers are, in fact, generally considered to be part of the base itself unless specifically excluded in the description (e.g., unsubbed polyester) Primer and subbing compositions are well known in the art and polymers of vinylidene chloride often comprise the primer composition of choice for photographic elements.

The antistatic layer of the present invention comprises the reaction product of (a) a water-soluble electrically conductive polymer, preferably having carboxylic groups and (b) a crosslinking agent for said electrically conductive polymer, preferably a polyfunctional epoxide crosslinking agent, the reaction product having a reduced level of water extractable components in the antistatic layers.

The term "water extractable components" as used in the practice of the present invention has a definite meaning. A water extractable component is a residual, unreacted, or low molecular weight (less than or equal to 3,000 actual molecular weight of the component) material in the crosslinked film. It is a relatively simple and conventional process to determine the total amount by weight of these water extractable components in the cured layer (WEC). The layer, at a standard thickness of 0.20 micrometers on a substrate (preferably photographic grade, polyvinylidene chloride [PVDC] primed polyethyleneterephthalate), is immersed in deionized water at ambient temperature (20 degrees Celsius). The weight amount of extractables (before and after extraction) is measured (or the weight loss of the layer is measured) and the percentage of extractables removed during the extraction process is calculated. If more than 80% by weight of the water extractables remain in the cured layer after 10 days of immersion, the layer has been properly cured according to the practice of the present invention. Prior to the development of the present process, this level of cure was not believed to be achieved using the compositions of copending application Ser. No. 07/797,456.

The component (a) of the antistatic layer of the present invention is preferably a water-soluble (e.g., soluble in water at room temperature at a level of at least 5% in weight, preferably at least 10%) electrically conductive hydrophilic copolymer having monomer units comprising:

(a') at least one $—SO_3M$ substituted ethylenically unsaturated monomer where M is $H+$, $NH_4+$, metal+ or $N(R)_4+$ where R is an alkyl group having 1–4 carbon atoms, and (b') at least one ethylenically unsaturated comonomer containing carboxylic groups, the molar ratio of (a') to (b') preferably being 1:1 to 5:1, and optionally (c') another ethylenically unsaturated monomer containing no free carboxylic groups (at least ratio of 0 to 1 , to 5 to 1 with respect to component a'). The average molecular weight of the polymers is usually between 16,000 and 60,000 most usually at the lower end of the molecular weight range.

More preferably, the component (a) is a copolymer of a styrene sulfonate and an ethylenically unsaturated comonomer containing carboxylic groups. Most preferably, the component (a) is a copolymer of sodium styrene sulfonate and maleic acid in a 2:1 to 4:1 mole ratio. The amount of units derived from electrically conductive monomers (a') serves to balance the requirements for antistatic protection with sufficient capability of the copolymer to become crosslinked through the carboxylic groups of units derived from monomers (b'). For example, monomer (a') may be styrene sulfonic acid, vinyltoluene sulfonic acid, a-methyl-styrene sulfonic acid, 2-ethyl-styrene sulfonic acid, 3-acryloyloxypropane-1-sulfonic acid, 3-methacryloyloxypropane-1-sulfonic acid, 2-acrylamido-2-methylpropanesulfonic acid, 3-methacryloyloxypropane-1-methyl-1-sulfonic acid, acryloylmethane-sulfonic acid, 4-acryloyloxybutane-1-sulfonic acid, 4-acryloyloxybutane-1-sulfonic acid, 2-acryloyloxyethane-1-sulfonic acid, 2-acrylamidopropane-1-sulfonic acid, 2-methacrylamido-2-methylpropane-1-sulfonic acid, 3-methacrylamido-3-methylbutane-1-sulfonic acid in the form of alkali metal salts thereof, preferably Na or K, or ammonium salts. Monomer (b') may be maleic acid, acrylic acid, methacrylic acid, 2-butenoic acid, etc. Monomer (c'), if present, is to be chosen so as not to negatively affect the electrical conductivity, water solubility and crosslinking capability of the polymers according to the present invention. Examples of monomers (c') are ethylenic monomers (such as isoprene, 1,3-butadiene, vinyl chloride, ethylene, propylene), styrene type monomers (such as styrene, vinyltoluene, a-methyl-styrene, 2-ethyl-styrene, 1-vinylnaphthalene), 2-alkenoic acid esters (such methyl, ethyl, propyl, butyl, hexyl esters of acrylic, methacrylic, a-ethylacrylic, a-propylacrylic, 2-butenoic acids), acrylamide monomers (such as acrylamide, N-methylacrylamide, N,N-dimethylacrylamide, N-butylacrylamide, Nchloromethyl-acrylamide) and vinyl acetate.

Examples of component (a) are poly(sodium styrene sulfonate—maleic acid), poly(sodium styrene sulfonate methacrylic acid), poly(sodium styrene sulfonate—butyl acrylate—methacrylic acid), poly(sodium-2-acrylamido-2methyl-propanesulfonate—maleic acid) and the like. These components (a) may be purchased commercially or synthesized by copolymerizing the monomers as known in the art.

The component (b) of the antistatic layer of the present invention is a polyfunctional epoxide crosslinking agent, that is, an organic compound, including a polymeric compound, containing at least two polymerizable epoxide groups therein Examples of component (b) are bis(2,3-epoxypropyl) ether, vinyl cyclohexene dioxide, ethylene bisglycidyl ether, bis(2,3-epoxypropylethyl) ether, hydroquinone bisglycidyl ether, resorcinol bisglycidyl ether, diepoxybutane, diepoxyhexane, bisglycidyl thioether, glycerol trisglycidyl ether, bisglycidyl malonic acid diethyl ester, bisglycidyl sulfone, N,N-bisglycidyl piperazine, trisglycidyl phosphate, 2,4,6-trisglycidyl cyanurate, oxalic acid bisglycidyl ester, succinic acid bisglycidyl ester, bis-(2,3-epoxypropyl)-methyl propyl ammonium p-toluene sulfonate, 1,5-pentane-bis(2,3-epoxypropyl diethyl ammonium methane sulfonate), 2-butyne-1,4-bis(2,3epoxypropyl dimethyl ammonium perchlorate). These compounds are well known in the art as shown in U.S. Pat. Nos. 2,882,250, 3,047,394, 3,189,459, and in FR Patent No. 1,231,056. These compounds may be purchased commercially or synthesized as taught in the above patents.

Prior to being provided on the polymeric base, the antistatic polymer (a) and the crosslinking agent (b) are dissolved in an aqueous solution The aqueous coating composition including the components (a) and (b) may be coated onto any suitable polymeric photographic base, but the preferred base is polyethyleneterephthalate film which has been subbed with a layer of resin, (e.g., PVDC) or layers of resin and gelatin. The antistatic coating is usually provided in a coating weight based on the dry weight of from 0.1 g/m$^2$, to 25 g/m$^2$, preferably 0.5 to 25 g/m$^2$. Lower coating weights usually provide less adequate antistatic protection and higher coating weights usually give less transparent layers. The coating may be performed by conventional coating techniques such as, for example, air knife coating, gravure coating, curtain coating, slot coating, or doctor roller coating. The antistatic layer of the present invention may also contain other addenda which do not influence the antistatic properties and the crosslinking capability of the combination of components (a) and (b), such as, for example, matting agents, plasticizers, lubricants, surfactants, dyes, and haze reducing agents. The presence of binders is not required, but limited amounts (such as, for example, less than 20%, preferably less than 10% in weight based on the weight of component (a)), of binders such as gelatin, may be added to the coating composition comprising components (a) and (b) to improve coating quality of the antistatic layer.

The reaction of (a) and (b) is effected by coating and drying of components (a) and (b) onto the polymeric substrate. Heating may be used to accelerate drying. Air temperatures of from 20° to 200° F. are useful for the drying-curing step, while the preferred range is 50° to 160° F. Catalysts may also be used to speed up the reaction.

The drying of the film is relatively important in the preparation of the coated films of the present invention. If the drying conditions are too harsh, the film will become desiccated and crack. If the conditions are too mild, the drying process will take too long and become economically unfeasible. It is most preferred to dry the coated but uncured film sheets at 60 degrees Celsius (140° F.) or less, and to dry them until they are just dry and not desiccated. This may mean a residual water content of between 0.1 and 6% by weight of the layer remains in the coated layer.

After the coated film has been dried, the film is wrapped about itself or about a core. The core may be any convenient size, and the thickness of the wrapped film may vary over a wide range. Cores of 3 inches (4.6 cm) to 10 inches (25.4 cm) and larger have been used without significantly adverse effects being noted in the process. It has been found to be very important that the thickness of the wrapping of the film be at least ¼ inch (0.64 cm) for the process to work. No upper limit on the thickness of the film has been determined. Thicknesses in excess of three feet (0.91 m) have been used with no adverse effects noted. Thicknesses of over or up to 3 or 5 meters would be conveniently used in certain cases. What is most surprising about the practice of the present invention is that the curing process has been tried in stacks of film, as continuous film moving through an oven, with acid catalysis for the reaction, with high and low dwell times at various temperatures, and other variations, but it is only when the coated film is rolled and then 'heat soaked', that is, placed in a heating environment for sufficient time for the heat to penetrate into the rolled film and raise the temperature of the internal layers of the film to the necessary temperature for the necessary period of time, that the desired properties of the coated film are obtained. Heating may be done in any non-destructive environment such as a forced air oven or heating room.

The necessary minimum temperature for the film to reach in the inner layers is at least 40 degrees Celsius. It is preferred that higher temperatures be reached to reduce the time necessary for the process. At a temperature of only 40 degrees Celsius, the induction time for the film in the innermost layers to reach that temperature is increased, and the length of time that the film must be maintained at that temperature becomes longer, ten to fifteen days or more. At an environmental temperature of 100 degrees Celsius, the temperature may have to be maintained for one to three days for the internal film temp to reach the desired minimum of 40° C. and preferably reach 60° C. At temperatures of at least 120 or 140 degrees Celsius, the temperature of the core film may be reached in only one day or less, and at temperatures of at least 60 degrees Celsius it may have to be held for only two days or less.

The reaction product of (a) and (b) is a crosslinked product, having three-dimensional bonding within the layer. The crosslinking helps provide a permanent antistatic layer which is water-insoluble and keep low molecular weight non-crosslinked materials within the component (a) from migrating out of the antistatic layer. Migration is reduced or eliminated into other photographic layers and/or into aqueous processing solutions by the tightening effect of the crosslinking on the internal structure of the antistatic layer. No additional conductive material need be added to any outer coating layer.

The imaging elements useful in the present invention may be any of the well-known elements for imaging in the field of graphic arts, printing, medical and information systems. Silver halide, photopolymer, diazo, vesicular image-forming systems may be used, silver halide systems being preferred.

Typical imaging element constructions of the present invention comprise:

1. The film base with an antistatic layer on one surface and the photosensitive layer or layers, preferably photographic silver halide emulsion layer or layers, on the other surface of the film base. In this construction an auxiliary layer may or may not be present over the antistatic layer but is preferable. Examples of auxiliary layers include backing gelatin protective layers and backing gelatin antihalation layers.

2. The film base with an antistatic layer on one surface and at least one photosensitive layer adhered to the same surface as the antistatic layer, over the antistatic layer.

3. The film base may have antistatic layers on both surfaces of the polymeric base and have at least one photosensitive layer on one or both sides of the film base, over said antistatic layers.

Examples of silver halide photographic elements applicable to this invention include black-and-white and color photographic elements.

The silver halide employed in this invention may be any of silver chloride, silver bromide, silver iodide, silver chlorobromide, silver chloroiodide, silver bromoiodide and silver chloroiodobromide.

The silver halide grains in the photographic emulsion may be regular grains having a regular crystal structure such as cubic, octahedron, and tetradecahedron, or a spherical or irregular crystal structure, or may be those having crystal defects such as twin plane, or those having a tabular form, or a combination thereof.

As the binder or protective colloid for use in the photographic element, gelatin is advantageously used. Other hydrophilic colloids may be used such as gelatin substitutes, collodion, gum arabic, cellulose ester derivatives such as alkyl esters of carboxylated cellulose, hydroxy ethyl cellulose, carboxy methyl cellulose, as well as synthetic resins, such as the amphoteric copolymers described in U.S. Pat. No. 2,949,442, polyvinyl alcohol, polyethylacrylate, polymethlacrylate, polybutylacrylate or their copolymers or latices and others well known in the art.

The photographic elements with the antistatic layer of this invention have radiation-sensitive silver halide emulsion layers, i.e., silver halide emulsions sensitive to the ultraviolet visible, or infrared light. The silver halide emulsions may be optically sensitized by any of the spectral sensitizers commonly used to produce desired sensitometric characteristics.

Methods for making such elements, means for sensitizing them to radiation, use of additives such as chemical sensitizers, antifoggant and stabilizers, desensitizers, brightening agents, couplers, hardening agents, coating aids, plasticizers, lubricants, matting agents, high-boiling organic solvents, development accelerating compounds, antistatic agents, antistain agents, and the like are described, for example, in Research Disclosure Vol. 176, No. 17643, December 1979, Sections I to XIV.

The following examples, which further illustrate the invention, report some experimental data obtained from processes and measurements which are of normal use in the art. The coating quality (opacity and unevenness) were evaluated by visual observation of the layer. Surface resistivity measurements were made using the following procedure: samples of each film were kept in a cell at 21° C. and 25% R. H. for 24 hours and the electrical resistivity was measured by means of a Hewlett-Packard High Resistance Meter model 4329A. As far as blocking or sticking is concerned, samples of each film were kept in contact with a conventional gelatin subbing under a load of 200 g and artificially aged for 3 days at 60° C. Subsequently, the two subbing surfaces were separated, visually examined and qualitatively evaluated for patterns (ferrotyping) due to the interaction between the antistatic layer under examination and the conventional gelatin subbing. The following examples also report four adhesion values: the first is the dry adhesion value and refers to the adhesion of the silver halide emulsion layers and of the auxiliary gelatin layers to the antistatic base prior to the photographic processing; the second and the third adhesion values are the wet adhesion values and refer to tile adhesion of the above layers to the antistatic base during the photographic processing (developer and fixer); the fourth adhesion value is the dry adhesion value and refers to the adhesion of the above layers to the antistatic base after photographic processing. In particular, the dry adhesion was measured by tearing samples of the film, applying a 3M Scotch ® Brand 5959 Pressure Sensitive Tape along the tear line of the film and separating rapidly the tape from the film: the layer adhesion was evaluated according to a scholastic method giving a value of 2 when the whole layer was removed from the base and a value of 8 when no part thereof was removed from the base and intermediate values for intermediate situations. The wet adhesion was measured by drawing some lines with a pencil point to form an asterisk on the film just taken out from the processing bath and by rubbing on the lines with a finger. Also in this case the adhesion of the layers was evaluated according to a scholastic method by giving a value of 2 when the layers were totally removed from the base, a value of 8 when no portion thereof was removed and intermediate values for intermediate cases. As far as dynamic wettability is concerned, a drop of gelatin silver halide emulsion was put on the surface of the antistatic layer and the spreading of the drop surface was measured.

The dynamic wettability value, as compared to gelatin surface was 82 ml/min versus 50 ml/min, this could allow superior coatability regarding pick-up at high speeds during the photographic layer application process, for example, application of emulsion layers. In the following examples, "RT" means room temperature, and "CD" means charge decay.

EXAMPLE 1

A coating solution of the antistatic composition was prepared according to the following formulation:

| | |
|---|---|
| Water | 91.98 parts |
| PSSMA | 7.00 parts |
| EGDE | 1.00 parts |
| FC127 | .02 parts |

PSSMA: co-polystyrenesulfonate-maleic acid sodium salt
EGDE: Ethyleneglycoldiglycidyl ether
FC127: fluorochemical surfactant Using a three-roll reverse-gravure coating process, a coating of the above solution was applied to a polyvinylidene chloride primed polyester graphic arts type film base at a speed of 250 feet per minute, and oven dried immediately thereafter at 40° C.(~120° F.) for approx. 30 seconds. The coated thickness as measured by ellipsometry was approximately 5000Å.

The roll of coated film (9.25 inches wide and one inch thick on a 3 inch inside diameter cardboard core) was placed in a forced air oven at 140° F. (60° C.) for 5 hours. Except for the securing of the outer wrap with tape, this roll was not wrapped or otherwise isolated in the oven. After 5 hours, 4 samples were taken from the heat soaked roll, cut into 8×10 inch sheets and designated samples 1–4 below. Samples 5 and 6 were taken from the roll prior to the heat soak.

The samples were evaluated under the following conditions:

TABLE 1

| Sample | Format | Environmental Conditions |
|---|---|---|
| 1 | 8 × 10 sheet | 12 hrs RT, 25% RH |
| 2 | 8 × 10 sheet | pass through RPD developer, 12 hrs RT 25% RH |
| 3 | 8 × 10 sheet | emulsion coated with graphic arts emulsion |
| 4* | 8 × 10 sheet | emulsion coated with graphic arts emulsion |
| 5 | 8 × 10 sheet | pass through RPD developer, 12 hrs RT 25% RH |
| 6 | 8 × 10 sheet | 5 hours at 140° F., pass through developer above condition as above |

4* was passed through a graphic arts film processor containing RPD developer at 100° F. under $D_{min}$ conditions. One more sample which was not heat soaked was overcoated with graphic arts emulsion and passed through a film processor and tested:

TABLE 2

| Sample | Charge decay | Surface Resistivity | Emulsion Adhesion |
|---|---|---|---|
| | Results: | | |
| 1 | 0.04 sec | $2 \times 10^9\Omega$ | |
| 2 | 0.08 sec | $1 \times 10^{10}\Omega$ | |
| 3 | 0.02 sec | $4 \times 10^9\Omega$ | 10 |
| 4* | 0.04 sec | $2 \times 6^{10}$ | 10 |
| 5 | infinity | $>10^{13}\Omega$ | |
| 6 | infinity | $>10^{13}\Omega$ | |
| 7 | Infinity | $>10^{13}\Omega$ | 0–2 |

4* was passed through a graphic arts film processor containing RPD developer at 100° F. under $D_{min}$ conditions. One more sample which was not heat soaked was overcoated with graphic arts emulsion and passed through a film processor and tested:

EXAMPLE 2

The examples which follow serve to re-inforce the uniqueness of the heat soak as the only method yet found to crosslink the composition of these examples. Samples of film were reverse gravure coated on the pilot line at 250 fpm with the following solutions:

TABLE 3

| Water | FC127 | SSMA Copolymer | EGDE |
|---|---|---|---|
| 94.06 | 0.02 | 5.2 | 0.74 (6% solids) |
| 95.98 | 0.02 | 3.5 | 0.4 (4% solids) |

When coated on the pilot coater using a 2.2 volume factor gravure the coated weights are about 2200A for 4% and 2800A for 6% solids solutions.

Oven drying conditions show the following: (for 4, 6, 8% solutions 2000, 3000, or >4000A coating thickness.)

TABLE 4

| Oven temp. | Gravure/ line speeds | condition of coating | CD after dev. 5 days | CD after dev. 14 days |
|---|---|---|---|---|
| 300 F. | variable | micro-cracked | 5 KV residual** | 5 KV residual** |
| 250 F. | variable | mircro-cracked | 5 KV residual** | 5 KV residual** |
| 200 F. | variable | micro-cracked | 5 KV residual** | 5 KV residual** |
| 170 F. | variable | micro-cracked | 5 KV residual** | 5 KV residual** |
| 140 F. | variable | not micro-cracked | 5 KV residual** | 5 KV residual** |
| 120 F. | variable | not mircro-cracked | 5 KV residual** | 5 KV residual** |

The above samples were washed in water, dried, retested, and showed identical results.

The samples above were coated with a layer of contact film photoemulsion and dried. The samples were tested for wet adhesion by immersion into rapid graphic arts developer (RPD), scored and rubbed vigorously. The adhesion of the emulsion to this coating layer is rated in terms of the degree of coating retention to the substrate, on an arbitrary visual scale of 0 (worst) to 10 (perfect). All the above samples were a zero. CD test showed >5KV residual charge. Graphic arts filmbase, gel subbed over PVDC prime yields a consistent 10 on this test as the control, CD values being >5KV residual.

Sample 1 from example 1 was likewise overcoated with a graphic arts photoemulsion, dried identically and tested for wet adhesion like the above. The wet adhesion was a 10. The CD results were 0.02 sec. The resistivity $5.10^{-10}$ Ohms.

All of the above non-heat-soak samples exhibited resistivity Values greater than $10^{-12}$ Ohms before testing, and post developer soaked samples were $>10^{-13}$ Ohms surface resistivity, indicating lack of crosslinking and dissolution of the coated layer onto the emulsion overcoat.

EXAMPLE 3

Single sheets of coated filmbase were prepared for post-dry heat-soak by the following means:

Sample 1—Conditioned at 20° C. and 80% RH for 24 hours and sealed into an aluminized polyester bag.

Sample 2—Left open and placed into an oven at 60° C. and 80% RH, for 5 hours.

Sample 3—Left at RT and RH (15–20%).

Sample 1 was placed into a dry oven at 60° C. for 5 hours, and then all three were cut into two equal sized samples and then one each were run through a graphic arts film processor containing RPD film developer at 100° F. The paired samples were then tested for pre and post process charge decay and surface resistivity. The results were:

TABLE 5

| Sample | CD (pre) | (post) | Ohms/sq (pre) | (post) |
|---|---|---|---|---|
| 1 | 0.04 | >5KV res | $2.10^{-9}$ | $>10^{-13}$ |
| 2 | 0.02 | >5KV res | $8.10^{-8}$ | $>10^{-13}$ |
| 3 | 0.16 | >5KV res | $4.10^{-10}$ | $>10^{-13}$ |

EXAMPLE 4

Thermocouples were inserted into a roll of 4 mil graphic arts photobase coated with a 2700 Angstrom thick layer of the antistatic formulation previously described, which was dried at 140° C. The temperature probes were located within 1 cm of the outside o the roll, at the approximate center of the roll, and within 1 cm of the core. The roll was 24 inches wide and contained 2300 lineal yards of material, and was on a 6 inch ID paper core. The roll was then subjected to a 140° F. environment. It was observed that after 40 hours the temperature of the roll was within 5° F. of the target 140° F. condition.

The humidity of the heat soak room was 5.9%. Samples were then cut from each area immediate to the probe and tested the same way as above. The results were:

TABLE 6

| Sample | CD (pre) | (post) | Ohms (pre) | (post) |
|---|---|---|---|---|
| outer | 0.02 | 0.2 | $6.10^{-9}$ | $8.10^{-9}$ |
| middle | 0.01 | 0.02 | $2.10^{-9}$ | $6.10^{-9}$ |
| inner | 0.03 | 0.06 | $3.10^{-9}$ | $8.10^{-9}$ |

EXAMPLE 5

Two 52 inches wide 700 lineal foot rolls of PVDC primed 4 mil graphic arts photobase were coated with the copolymer coating.

previously described. The coating was applied to the base in a conventional gravure process, and was dried at a temperature of 130° F. for 30 seconds, and each roll was wound onto core in a conventional manner. After approximately 24 hours, one roll was placed into a room maintained at 140° F. (60° C.) for 100 hours. The second roll was left at RT. After one week the two rolls were coated with a silver halide photographic emulsion and matte topcoat in a conventional manner. The rolls were then tested by cutting samples out of the center of each roll and subjecting them to the photodeveloper process as described previously. The unprocessed and processed samples, along with a control (same coating on a standard gel primed polyester base) were conditioned at rt and 25% RH for 24 hours prior to testing. The test results were:

TABLE 7

| Sample | CD (pre) | CD (post) | Ohms (pre) | Ohms (post) | wet adh (pre) | (post) |
|---|---|---|---|---|---|---|
| non heat soak | 3.3 | 5DV res | $2.10^{-12}$ | $>10^{-13}$ | 0 | 0 |
| heat soak | 0.4 | 0.2 | $4.10^{-10}$ | $2.10^{-10}$ | 10 | 10 |
| control | 5KV res | 5KV res | $>10^{-13}$ | $>10^{-13}$ | 10 | 10 |

The samples show that the process of heat soaking the wound rolls coated with this copolymer and bis epoxide crosslinking agent causes the desired crosslinking to occur. The mechanism of this reaction is not understood. The ramped time dependent esterification can be demonstrated at heat soak temperatures above 120° F. If heat soak temperatures exceed about 200° F. there is an adverse effect on the properties of the film-base and coating. The participants in this reaction are —COO— and the bisepoxide. Other polymers, and other bis epoxides will work. Any carboxylated material, ring opened carboxylic acids, and bis-epoxides -tri-epoxides, can be employed.

What is claimed is:

1. A method for making an antistatic polymeric photographic film base comprising coating onto a polymeric photographic film base a solution comprising an antistatic polymer and crosslinking agent for said antistatic polymer, drying said solution to form a dried coating on said, film base to form a coated film base wrapping said substrate with the coating thereon into a roll of at least 0.64 cm thickness of the wrapping and allowing said crosslinking agent to crosslink said antistatic polymer.

2. The method of claim 1 wherein said wrapping of said coating film base is done about a core and the thickness of said core is at least 3 inches up to 10 inches.

3. The method of claim 1 wherein said heating of said wrapped film base is done at temperature of at least 40 degrees Celsius up to 140 degrees Celsius.

4. The method of claim 3 wherein said temperature is a nondestructive temperature maintained at 60 to 140 degrees Celsius.

5. The method of claim 1 wherein said antistatic polymer comprises a watersoluble electrically conductive hydrophilic copolymer derived from a) at least one ethylenically unsaturated monomer having at least one —$SO_3M$ group wherein M is selected from the group consisting of hydrogen, ammonium, metal, or amine.

6. The method of claim 5 wherein M is an amine represented by the formula $N(R)_4^+$ where R is an alkyl group of 1–4 carbon atoms.

7. The method of claim 5 wherein said antistatic polymer further comprises b) an ethylenically unsaturated monomer having at least one carboxylic acid group.

8. The method of claim 6 wherein said antistatic polymer further comprises units derived from b) an ethylenically unsaturated monomer having at least one carboxylic acid group.

9. The method of claim 7 wherein the molar ratio of a) to b) is from 1:1 to 5:1.

10. The method of claim 8 wherein the molar ratio of a) to b) is from 1:1 to 5:1.

11. The method of claim 5 wherein said antistatic polymer comprises a copolymer of a styrene sulfonate and an ethylenically unsaturated monomer having carboxylic acid groups.

12. The method of claim 10 wherein said antistatic polymer comprises a copolymer of a styrene sulfonate and an ethylenically unsaturated monomer having carboxylic acid groups.

13. The method of claim 5 wherein said wrapped film base is maintained at a temperature of at least 60 up to 140 degrees Celsius for five hours to two days.

14. The method of claim 11 wherein said wrapped film base is maintained at a temperature of at least 60 up to 140 degrees Celsius for five hours to two days.

15. The method of claim 4 wherein said antistatic polymer further comprises units derived from a monomer having carboxylic acid groups.

16. The method of claim 1 wherein said crosslinking agent comprises a polyepoxide crosslinking agent.

17. The method of claim 4 wherein said crosslinking agent comprises a polyepoxide crosslinking agent.

18. The method of claim 10 wherein said crosslinking agent comprises a polyepoxide crosslinking agent.

19. The method of claim 13 wherein said crosslinking agent comprises a polyepoxide crosslinking agent.

20. The method of claim 14 wherein said crosslinking agent comprises a polyepoxide crosslinking agent.

21. The method of claim 1 wherein after said antistatic polymer is crosslinked, a layer comprising gelatin is coated over the antistatic polymer.

22. The method of claim 1 wherein after said antistatic polymer is crosslinked, a layer comprising a silver halide emulsion is coated over said antistatic polymer.

23. The method of claim 21 wherein after said layer comprising gelatin is coated, a layer comprising a silver halide emulsion is coated over said layer comprising gelatin.

24. The method of claim 1 wherein at the sam e time that said solution is coated into said substrate, a layer comprising gelatin is coated over said solution.

25. A method for making an antistatic polymeric, imaging film base comprising coating onto a polymeric imaging film base a solution comprising an antistatic polymer and crosslinking agent for said antistatic polymer, drying said solution to form a dried coating on said film base to form a coated film base, wrapping said substrate with the coating thereon into a roll of at least 0.64 cm thickness of the wrapping of the coated film base, and heating said wrapped film base while it is wrapped and allowing said crosslinking agent to crosslink said antistatic polymer.

* * * * *